United States Patent [19]

Thorne

[11] 4,399,748

[45] Aug. 23, 1983

[54] MULTIPLEXED HAMMER DOT BAND MATRIX PRINTER

[75] Inventor: William D. Thorne, Wake Forest, N.C.

[73] Assignee: International Business Machines Corp., Armonk, N.Y.

[21] Appl. No.: 333,092

[22] Filed: Dec. 21, 1981

[51] Int. Cl.[3] ..... B41J 3/00; B41J 7/70

[52] U.S. Cl. ..... 101/93.04; 101/93.09; 101/93.14; 400/121

[58] Field of Search ..... 101/93.04, 93.05, 93.09, 101/93.14, 93.29, 93.48; 400/121, 125, 146

[56] References Cited

U.S. PATENT DOCUMENTS

| | | | |
|---|---|---|---|
| 3,575,107 | 4/1971 | McDowell et al. | 101/93.14 |
| 3,654,857 | 4/1972 | Marsh, Jr. | 101/93.14 |
| 3,672,297 | 6/1972 | Berglund et al. | 101/93.09 |
| 3,719,139 | 3/1973 | Niccolai | 101/93.09 |
| 4,055,117 | 10/1977 | Munday | 101/93.09 |
| 4,064,800 | 12/1977 | Paccione et al. | 101/93.14 |
| 4,260,268 | 4/1981 | Arai | 101/93.04 |

FOREIGN PATENT DOCUMENTS

| | | |
|---|---|---|
| 7507826 | 1/1976 | Netherlands . |
| 1470283 | 4/1977 | United Kingdom . |

*Primary Examiner*—Edward M. Coven
*Assistant Examiner*—John A. Weresh
*Attorney, Agent, or Firm*—Edward H. Duffield

[57] ABSTRACT

Hammers impact dot font elements on a moving band and drive them into a printing medium. The pitch between two dot font elements is assigned to two adjacent hammers in this invention. An electronic control is used so that adjacent hammers cannot be fired simultaneously. Hammers in a bank are divided into two groups with members of each group alternating on a one for one basis along the hammer bank. Hammers which are fired in a group will all be operating on the same relative dot position in their space in the line of print being formed. With prior dot band hammers, additional spacing is allowed between dots on the band to avoid the problem of nipping and crashing of the anvil elements on the back of the dot band into extended faces of adjacent print hammers. This has created a small gap in which no dots can be created. The present invention also provides a means for automatically selecting large or small dots for printing if the print band has large and small size dot font elements alternated serially on it. It is only necessary to choose firing the hammers of the first group or the second group first in order to select large dots or small dots for printing.

4 Claims, 4 Drawing Figures

MULTIPLEXED HAMMER DOT BAND MATRIX PRINTER

FIELD OF THE INVENTION

This invention relates to dot matrix printers in general. In particular, it relates to the band and hammer style of dot matrix printers. In such printers a moving carrier or band element carries a plurality of dot font or print elements in front of a fixed bank of impact hammers.

PRIOR ART

A variety of dot band matrix printers are known in the art. Examples may be seen in the following patents. Netherlands Pat. No. 7507826 and German Pat. No. 2525528; also British Pat. No. 1,470,283 and German Pat. No. 2432499 show similar structures. In all of these, however, a hammer position generally occupies the space between two consecutive dot font or printing elements on the band or belt. A small allowance of additional spacing of dot elements on the belt is made for the purpose of preventing a projecting hammer face from causing an inadvertent collision (called nipping or crashing) with an oncoming dot font anvil element on the backside of the belt. This can occur if a hammer should fail to be retracted soon enough. The general hammer width that results is chosen based on the maximum repetition rate at which the hammer firings can be conducted and upon the desired horizontal pel in conjunction with the total throughput of printing that is required.

Ordinarily, to reduce the expense of hammers and hammer mechanisms, the hammer faces are extended to cover more than one or two character positions in desired printing line. The greater width hammers of course involve higher mass which requires higher driving currents in the magnetic or electromagnetic driving circuits. This results in higher coil heating and in more demand on the power supply system. Also the repetition rate with which the hammers can be successively fired goes down since the higher mass hammers cannot be so rapidly oscillated. Throughput is affected since the pitch of elements on the belt will be approximately the hammer pitch plus the necessary clearance.

It is the additional small amount of clearance that reduces the throughput because a given dot font element that follows a first dot font element will not be operating at the same time in the print line upon the same relative position in front of its hammer. Therefore, a small delay will occur until the dot is appropriately positioned to begin printing. The control of the hammer firing circuits is further complicated by the small amount of clearance space allowed in the pitch of the dot font elements on the belt or band.

The problem can be easily visualized if one imagines a hammer bank of, say, four hammers and a band with at least four print elements positioned adjacent to the hammers. If the first hammer in the row is working on the dot font element with that element positioned near the edge of the hammer; the adjacent hammer will have a dot font element that is positioned closer to the center of the face of the hammer; and the next adjacent hammer will have a dot font element closer to the other extreme edge of the hammer, and so forth. The net result is that the dot font elements will not be aligned with the same relative character positions in front of their respective hammers at the same time. This greatly complicates the matter of timing the hammer firings to create dots at the desired points on the printing medium.

In addition, it is most difficult to print all the possible printing positions in the horizontal line since there will be a small space between hammers at which no firing can occur either for clearance reasons or to avoid the nipping and crashing problem within the timing and synchronization capabilities of the system.

OBJECTS OF THE INVENTION

In view of the foregoing known deficiencies in the known prior art, it is an object of the present invention to provide an improved dot band and hammer matrix printer in which the hammer position, defined as the spacing from center to center between two consecutive same style or size fonts on the dot band, is assigned to two adjacent hammers. Therefor, the hammer position defined includes, instead of the normal single hammer, two hammers, each of the hammers covering one half of the spacing. The hammer pitch which results will be one half the pitch of the same size dot font element's pitch on the belt.

A further object of the present invention is to provide an improved dot band matrix printer in which smaller size hammers with lower mass and higher repetition rates and reduced hammer solenoid coil heating and power supply loading is involved.

Still a further object of the present invention is to provide an improved dot band matrix printer in which physical clearance tolerances between dot elements and hammer faces are greatly increased to eliminate nipping and crashing problems while also providing a means of eliminating the hammer to hammer gap in the resulting printed line.

Still a further object of this invention is to provide increased throughput and reduced cost for a multi font dot or dot size band printer.

A further object of this invention is to provide for the allowance of increased anvil size for improved wear characteristics of the hammer face and anvil.

Also, an object of the invention is to allow for additional tolerances of timing due to the increased nipping and crashing protection.

SUMMARY

The foregoing and still other objects which have not been enumerated are met in the present invention by providing two individual hammers for the usual single hammer space. The hammer space is defined as the spacing between adjacent like size dot font elements on the print band. The hammers are alternated with one another and divided into A and B groups, respectively. Controls are instituted to assure that hammers in one group cannot be fired at the same time hammers in the other group are being fired. This greatly increases the clearance and makes possible setting the pitch of the dot font elements of like size to be exactly equal to twice the exposed individual hammer face width. This is a distinction over the normal printer in which the hammer is twice as wide and in which the dot font elements are spaced at somewhat greater distance than twice the hammer width in order to allow the necessary timing clearances. In addition, the half wide hammers in the novel arrangement of the present invention can be vertically staggered so as to overlap one another slightly to eliminate the interhammer gap. Also, if dot font elements of two sizes are alternated sequentially on the band or belt, it is only necessary to select the firing of hammers in a group A rather than hammers in a group B to occur first, followed by firing hammers in the group B or the group A respectively, in order to select printing of either dot font elements of one size or of the other.

BRIEF DESCRIPTION OF THE DRAWINGS

The present invention will be further described with reference to a preferred embodiment thereof as shown in the attached drawings in which.

DETAILED SPECIFICATION

Figures 1, 2:
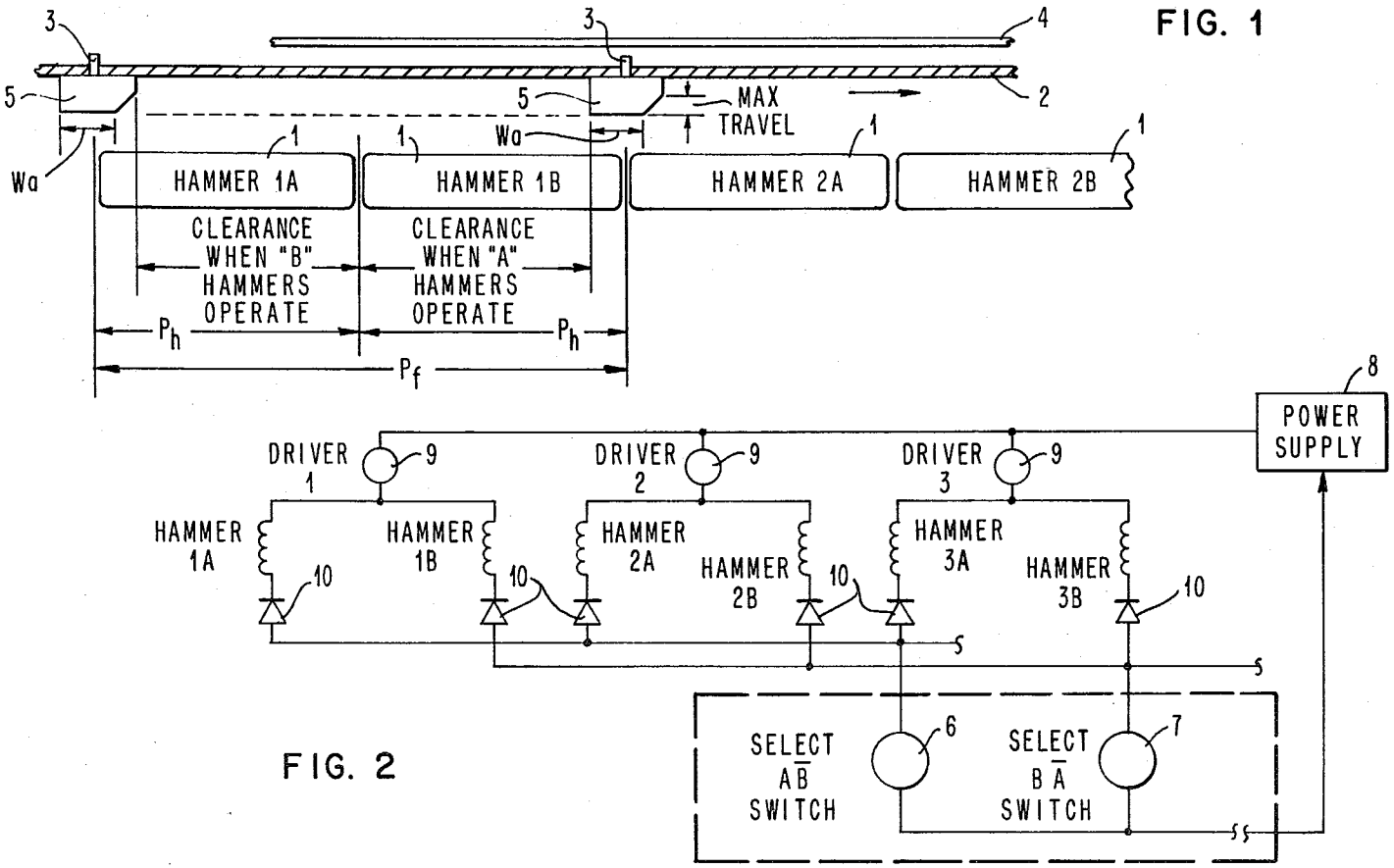
FIG. 1 schematically illustrates the novel arrangement of dot band elements relative to the hammer faces in the present invention.
FIG. 2 illustrates schematically an electronic control circuit for multiplexing adjacent hammer drive solenoids and preventing hammers in one group from firing while hammers in the other group are being fired.

Turning to FIG. 1, a schematic diagram of a plan view of a preferred arrangement according to the present invention is described. The basic elements are a hammer bank 1 comprised of numerous hammers labeled 1A, 1B, 2A, 2B, etc., a moving band or belt 2 seen edge on and a series of dot font elements 3 backed up by anvil members 5. The general details of this type of mechanism are known in the prior art as shown by the above-mentioned patents. In operation, each hammer may be individually activated by an electrical solenoid to move forward and impact the back surface of the anvil member 5, driving the dot font element 3 against a printing medium 4. A ribbon may be interposed between the dot font elements and the media 4 and a platen will generally be placed behind the medium 4 as will be clearly understood by those of skill in the art.

The pitch of the font members is labeled as $P_f$. This is normally the approximate hammer pitch in the known prior art, but it will be observed that in the present instance, two hammers occupy this place and each has a hammer pitch $P_h$ equal to $\frac{1}{2}$ of the font pitch $P_f$. As will be described in further detail, circuitry is arranged for driving the hammers such that the A hammers and the B hammers never operate in the same time. Therefore, it may be seen that if hammers A are operating against anvils in front of them, there is no problem with simultaneous operation of the A hammers since the anvils 5 cannot crash or nip against the extended faces of the A hammers. Similarly, the B hammers can only be operated when the A hammers are not operating so that equal clearance is provided to the A hammers when the B hammers are operating.

It will be observed that the striking face on the anvils 5 has a width $W_a$ which is great enough to span the small gap between the A and B hammers. Thus, the A hammer may be operated to impact the anvil 5 and print a dot in the small intervening gap between the hammers A and B. At that point the anvil 5 will overlap hammer B slightly so that it will then become safe for operating hammer B without nipping or crashing.

Turning to FIG. 2, the electrical schematic for the control and synchronization of the hammer shown in Figure A is illustrated. Selector switches 6 and 7, respectively, select operation of A hammers but not B hammers or B hammers but not A hammers by blocking out connection from the power supply 8 to the appropriate group. Individual solenoid coils are enumerated as hammer 1A, 1B, 2A, 2B, etc., and are supplied with current through a transistor driver amplifier 9 connected to power supply 8. Blocking diodes 10 are utilized in series with each solenoid coil 1A, 1B, etc., in order to prevent surges and back EMF generations as is well known in the art.

Controls for operating the selector switches 6 and 7 are not shown in detail. It is well known in the band and hammer style of printer to provide optical or other sources of indicia on the moving band which can generate emitter output pulses for timing hammer impacts. It is only necessary to count some number of these pulses starting from an initial homing position in order to determine whether the half hammers A or B are appropriately positioned for firing. Circuitry of this type is known and employed in printers of this style, but the selection is made between individual hammers which span the entire font pitch or nearly the entire font pitch, allowing for a small clearance gap to prevent nipping or crashing. In the present invention, this timing need only be divided in two equal parts and to exclusively gate half of the timing signals to one of the half hammer bank and the other sequence of timing signals to the other half hammer bank. Therefore the details of the timing are not shown since they do not form a specific part of the present invention and are quite obvious to those of ordinary skill in this art.

What is not so obvious are the numerous benefits and advantages that flow from providing two hammers in the print line space or font element pitch area where only one has previously been used. The first advantage is that the smaller relative size and mass of each hammer allows a higher individual hammer repetition rate to be achieved. This means that the sequential firings of each hammer can occur much faster to generate a higher density horizontal pel as will be appreciated by those of skill in the art. In addition, the font element pitch can be exactly two times the hammer pitch since the small clearance normally allowed in the prior art (where the font pitch is made larger than the hammer pitch when a single hammer spans most of the space between font elements) need not be provided. The reason for this is clear upon inspection of FIG. 1 where the clearance between hammer 1A and 1B halves in this sequential kind of firing scheme is clearly depicted. An increase in reliability also flows from this design since there will only be approximately half the number of mechanical operations for each hammer than would ordinarily be the case if the hammer were the full width of the font pitch. Also, there is less heating of the hammer driver coils due to lower current requirements for driving the smaller mass hammers and less frequent operation thereof.

Because of the greater hammer to anvil nip and crash protection clearances provided by this concept, the anvils themselves can be widened to a width $W_a$ as shown which more than adequately spans the hammer to hammer gap; whereas in the prior art designs, widening the anvils only increases the severity of the nipping and crashing problem.

A further unobvious benefit that flows from this design is that since the font pitch can be made to exactly equal twice the hammer pitch, the relative position of each dot font element in front of its associated hammer will be the same. This means that in constructing a line of print, all of the hammers then operating will be operating on the same dot character position in sequence in front of them. This is not the case in the known prior art where the font pitch is somewhat greater than the hammer pitch for clearance reasons. The result of that prior art design would be that each succeeding dot font element would occupy a position somewhat behind that relatively occupied by the one preceeding it in front of its hammer and would therefore be operated at a different dot position within the desired character format in front of the hammer. The improvement in the present invention greatly simplifies the control for the hammers since it is not necessary to keep track of the absolute position of each dot font element individually.

Further benefits flow from this design in reduced costs. The use of more hammers may, at first blush, seem to increase the cost. However, the economies of scale production of multiple identical units come into play to reduce the cost of the individual hammers. In addition, the relatively narrower and lighter hammers need much less torsional resistance, can be more easily constructed and are less likely to deterioriate in usage than the wide hammers that would have the full font element pitch. In addition, cooling problems are greatly reduced since the individual hammer drive coils are only used half as frequently as would be a coil for a hammer twice the width of those shown.

Still further advantages flow in unobvious fashion from the adoption of multiple hammers sharing the space normally occupied by a single prior art print hammer. Some of these have been alluded to above and still others will be described in the following portions of the specification.

Figure 3:
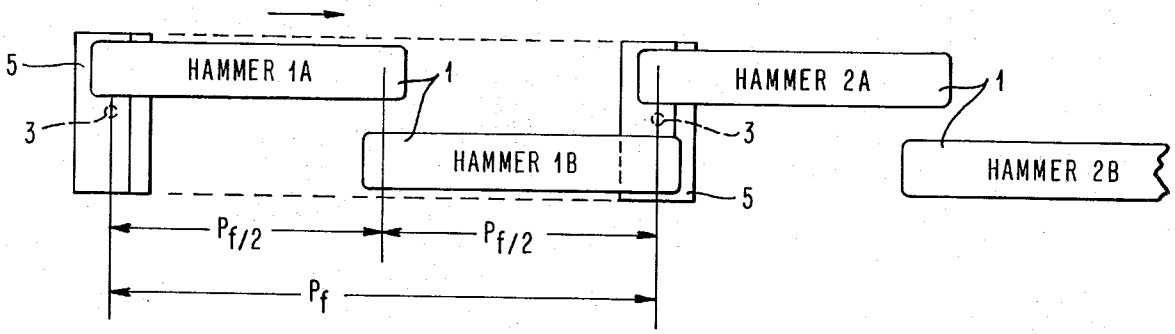
FIG. 3 illustrates schematically how the hammer faces can be vertically staggered and overlapped in the horizontal direction in order to eliminate the interhammer gap where no dots can be effectively printed in the normal prior circumstance but which can be with this invention.

Turning to FIG. 3, a schematic drawing indicating an alternative embodiment to the present invention is shown. In FIG. 3, the hammers 1A, 1B, etc., are all identified as hammer 1 and the anvils 5 are depicted in their positioning at a pitch of $P_f$ in the same fashion as indicated in FIG. 1 but with the horizontal elevation view intended. Therefore, the hammer faces 1 overlie the positions of the anvils 5 as seen in FIG. 3. It will be further noted that the hammer faces are staggered in the vertical direction and are elongated in the horizontal direction to slightly overlap one another.

This means that the total expanse of hammer face is somewhat greater than the total distance between adjacent dot font elements. However, since the hammers overlap, the effective hammer pitch remains one half that of the font element pitch as was the case in FIG. 1. The degree of overlap in the horizontal direction indicated in FIG. 3 eliminates the interhammer gap and provides an opportunity for operating either hammer against a given anvil without nipping or crashing occurring. This simplifies timing accuracy required, eliminates the interhammer gap, and reduces the wear on the anvil by providing twice the anvil surface for impact by the individual hammers.

The anvils 5 are elongated in the vertical direction as shown in FIG. 3 so that they may be struck by either hammers in the upper rank or in the lower rank. As shown in FIG. 3, the A hammers form an upper rank, while the B hammers form a relatively lower rank. Again, the hammers are operated in grouped banks in mutually exclusive fashion as described with reference to FIGS. 1 and 2.

Figure 4:
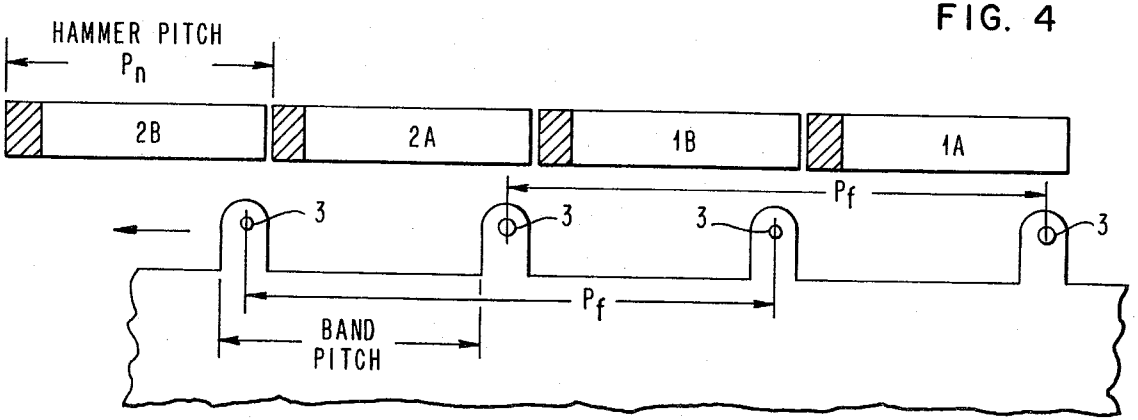
FIG. 4 illustrates the novel arrangement of the present invention in which dots of two different sizes are alternated at equal spacing on the band and in which automatic selection of the printing of dots of the desired size by all of the hammers can be chosen by merely selecting which group of hammers is fired first.

Turning to FIG. 4, another modification of the preferred embodiment of the invention is illustrated. In FIG. 4, the font pitch between font elements of like size remains the same $P_f$ as that shown in the previous figures. However, additional font elements are alternated on the belt which have a different font size.

Viewing FIG. 4, a schematic drawing of a band 2 with upstanding finger or ear portions each carrying a font element 3 is shown in a front elevation view. The hammer faces A and B are alternated as shown in FIG. 4 and the hammer pitch $P_h$ is the same as previously noted, one half that of the pitch $P_f$. A small shaded band is indicated across the faces of each hammer A and B in FIG. 4. This is a small area in which no printing should occur in order to prevent nipping of the hammer against anvils (not shown in FIG. 4) since the width of each hammer face A or B is equal to the distance between two adjacent unlike font size elements and such a problem could arise in an arrangement of hammer faces relative to the anvil and dot elements as shown. Throughput would, however, be reduced. However, by utilizing the overlapped hammer arrangement staggered vertically as shown in FIG. 3, this problem can be easily overcome and no small area during which printing is not allowed would be necessary.

An unobvious and unique advantage flows from the use of large and small dots spaced at a pitch $P_f$ equal to twice the width of an individual hammer as shown in FIG. 4. It is often desirable to print various style characters in other languages, for example, in the Japanese Kanji character set. The construction of such characters by dot matrix methods requires either a great number of small dots or a relatively smaller number of large dots. Unfortunately, for best character resolution and for upper and lower case of such characters, both large and small dots are required for ideal appearance.

The font size of 24 dots vertically by 24 dots horizontally is generally accepted if a resolution of one half the number of dots is attainable. Two sizes of characters are generally required, the smaller character being one half the size of the larger character. It is, therefore, required for the same quality of printing that the dot sizes be equally proportioned.

The present invention as illustrated in FIG. 4 provides for an automatic and easy selection of dot font size to select small dots for high character resolution or large dots for for larger characters or lower character resolution. The only choice necessary to select the sequence of dots is to choose the order of firing of the A hammers or the B hammers first or vice versa. By selecting firing of B hammers first in the illustration shown in FIG. 4, large dots will be printed. Following the firing of B hammers first, the A hammers will be fired, but at that time the large dots will be adjacent to the A hammers and printing with large dots will continue. The opposite case is true if the A hammers should be chosen to be fired first. Therefore, merely by selecting which rank of hammers will be fired first, one can select the resolution produced by the specific dot font elements. The same advantages attributed to the present invention with relationship to FIGS. 1–3 also accrue to this modification of the embodiment, but the additional advantages of dot font size selection by the easy method of altering the multiplexing order from A to B instead of from B to A also flow as noted.

In operation, the invention as embodied in FIG. 4 can print either large characters or small characters at the same speed so long as an entire line of print is devoted to characters of the same size. Intermixing characters of different sizes which requires intermixed firing of hammers against both large and small dots will approximately double the time for printing the line. However, the tradeoff and ease of selecting character font resolution more than makes up for this slight annoyance.

It will be observed in the preferred embodiments above that the power driver supply remains the same as that for the prior art devices which had only half the number of hammers and solenoid circuits shown in the present invention. However, the overall peak load demand on the power supply and drivers is reduced since the hammers themselves are smaller and lighter and since the average number of hammer firings will be somewhat reduced due to the fact that there may not be any need to fire both halves A and B of a previously defined hammer position for every set of characters to be printed.

Other economies in producing the hammer assemblies also flow from this design. Wider hammers, such as those normally employed in spanning nearly the entire font pitch $P_f$ are more difficult to build since the torsional stresses placed on the mechanisms must be accounted for by stiffening the hammer support arms, etc. Providing two hammers within the space normally assigned to one hammer in the prior art and then multiplexing the firing of the hammers to be in ranks either in the first half of all hammer positions or the second half, etc., as described, produces a number of unique and unobvious advantages as briefly alluded to above.

The principle can be extended and more than two hammers per defined hammer position relative to the printing band could be utilized. For example, three, four or even more hammers could be similarly multiplexed if desired. However, the increasing number of hammers will not always have a positive cost tradeoff as will be readily appreciated by those of skill in the art. Nevertheless, there exist circumstances for special purposes under which more than two hammers may be assigned the task and multiplexed in accordance with the teachings of the present invention.

Also, while only two dot sizes have been shown in the alternative preferred embodiments of the present invention, more dot sizes are possible. Eventually this will have a negative effect upon throughput as briefly described with reference to the two font sizes depicted. Equally true, however, is the fact that a further dot font selection capability by multiplexing can prove advantageous in special purpose situations.

Another application of dot size selection is in the production of gray tones or color tones. The darkest tone or shade would be perceived by the human eye to be the larger size dot, lighter tones or shades by smaller dots. It is therefor possible to tone or shade graphics by dot size selection.

Therefore, while the invention has been described with reference to a preferred embodiment thereof and a modification thereof, the general principles and method of operation will be clear to those of skill in the art and it will be easily comprehended therefor that the invention as described in the claims which follow is not intended to be limited thereby but are given as examples only of the invention for which protection is sought.

I claim:

1. In a moving dot band and fixed hammer bank dot matrix printer having a hammer position defined as the spacing from center to center between two consecutive dot font elements of like size on said dot band, the improvement comprising:

two adjacent hammer mechanisms assigned to said hammer position, each covering one half of said hammer position and having a hammer face pitch equal to one half of the dot font pitch between same size dots on said band with each said hammer being provided with a separate electrical actuation mechanism;

means for ordering the operation of said electrical actuation mechanisms by even and odd groups defined by sequentially numbering all the hammers and taking the even and odd numbers as group designations;

said ordering of operation being such that only members of the even or the odd group can be operated at any time interval and only the odd or even members, respectively, can be operated in the next preceding or succeeding time intervals;

the arrangement in which said adjacent hammers have their faces vertically staggered and horizontally extended in overlapped relationship such that each hammer face overlaps a portion of each adjacent hammer's horizontal span; and each dot font element having a hammer impact surface extending vertically so as to be operated on by either the higher or the lower vertically staggered hammer faces.

2. In a moving dot band and fixed hammer bank dot matrix printer having a hammer position defined as the spacing from center to center between two consecutive dot font elements of like size on said dot band, the improvement comprising:

two adjacent hammer mechanisms assigned to said hammer position, each covering one half of said hammer position and having a hammer face pitch equal to one half of the dot font pitch between same size dots on said band with each said hammer being provided with a separate electrical actuation mechanism;

means for ordering the operation of said electrical actuation mechanisms by even and odd groups defined by sequentially numbering all the hammers and taking the even and odd numbers as group designations;

said ordering of operation being such that only members of the even or the odd group can be operated at any time and only the odd or even members, respectively can be operated in the next preceding or succeeding time intervals; and said dot band comprises an equal number of dot font elements of two different size, said dot font elements being interleaved on a one for one basis with a dot font pitch equal to one said defined hammer position width.

3. The apparatus as described in claim 1, wherein:

said dot band comprises an equal number of dot font elements of two different sizes, said dot font elements being interleaved on a one for one basis with a dot font pitch equal to one said defined hammer position width.

4. The apparatus as described in claim 1 or claim 2, wherein:

said apparatus includes a control means connected to said electrical actuation mechanism for each said hammer so that adjacent hammers are connectable to a power supply in mutually exclusive order among each pair of adjacent hammers.

* * * * *